United States Patent [19]

Lavelette

[11] Patent Number: 4,709,479

[45] Date of Patent: Dec. 1, 1987

[54] SHINGLE REMOVING MACHINE

[76] Inventor: William J. Lavelette, 3137 South Superior St., Milwaukee, Wis. 53207

[21] Appl. No.: 910,061

[22] Filed: Sep. 22, 1986

[51] Int. Cl.[4] ..... E04D 15/00

[52] U.S. Cl. ..... 30/170; 15/93 R; 299/37

[58] Field of Search ..... 30/169, 170; 15/93 R; 172/19, 20; 254/131.5; 299/10, 37

[56] References Cited

U.S. PATENT DOCUMENTS

| | | | |
|---|---|---|---|
| 1,128,145 | 3/1917 | Whittier . | |
| 1,841,135 | 1/1932 | Lehman . | |
| 2,245,544 | 6/1941 | Miller | 30/170 X |
| 2,326,514 | 8/1943 | Bard | 30/170 X |
| 2,519,138 | 8/1950 | Katz | 299/37 |
| 3,695,713 | 10/1972 | Rothi et al. | 30/170 X |
| 3,779,605 | 12/1973 | Nieman | 299/37 |
| 4,089,098 | 5/1978 | DeMarco | 29/239 |
| 4,277,104 | 7/1981 | Sanchez | 299/37 |
| 4,453,773 | 6/1984 | Toffolon | 299/37 |

FOREIGN PATENT DOCUMENTS

| | | | |
|---|---|---|---|
| 167790 | 8/1921 | United Kingdom | 299/37 |

*Primary Examiner*—E. R. Kazenske
*Assistant Examiner*—Michael D. Folkerts
*Attorney, Agent, or Firm*—Leo Gregory

[57] ABSTRACT

A power operated shingle removing machine utilizing a pneumatic power source and cylinder, the machine being sufficiently light in weight to be lifted onto a roof, the machine consisting of a wheel supported frame, a series of forwardly diverging operating members supported on the frame, a blade supported upon the leading edge portion of the operating members and being angled downwardly to face a leading edge of shinges, a piston controlling the operating members, the upward action of the piston tilting the forward edge of the blade downwardly and the downward action of the piston causing the machine and operating members to advance and cause the blade in moving forwardly to underlie the facing leading edge portion of shingles and in this same action causing the blade to tilt upwardly tearing the engaged shingles loose from the roofing boards.

4 Claims, 5 Drawing Figures

SHINGLE REMOVING MACHINE

BACKGROUND OF THE INVENTION

1. Field of the Invention

This invention relates to a shingle removing machine.

2. Description of the Prior Art

It is a common practice to use hand tools on the order of pry bars for the removal of shingles. As examples of tools used, reference is had to U.S. Pat. No. 1,218,145 to W.L. Whittier which discloses a hand operated blade type of tool. Further reference is had to U.S. Pat. No. 1,841,135 to L. Lehman which discloses a tool similar to that disclosed in the above mentioned patent and these appear to be representative of tools in use for shingle removing purposes.

It is desirable to have a power actuated machine to remove shingles whereby several tabs of shingles may be removed at a time and the time required for the work to be done is greatly shortened.

SUMMARY OF THE INVENTION

It is the purpose and an object of this invention to provide a power actuated machine to remove shingles from a roof surface.

It is another object of this invention to provide a shingle removing machine which may be hand controlled but power actuated.

With reference to the previous object, it is also an object of this invention to provide a shingle removing machine capable of removing a plurality of shingles at a time.

More specifically it is an object of this invention to provide a powered hand controlled shingle removing machine readily portable and capable of removing a plurality of tabs at a time whereby there is a significant reduction in the time period for the removal of shingles from a roof.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
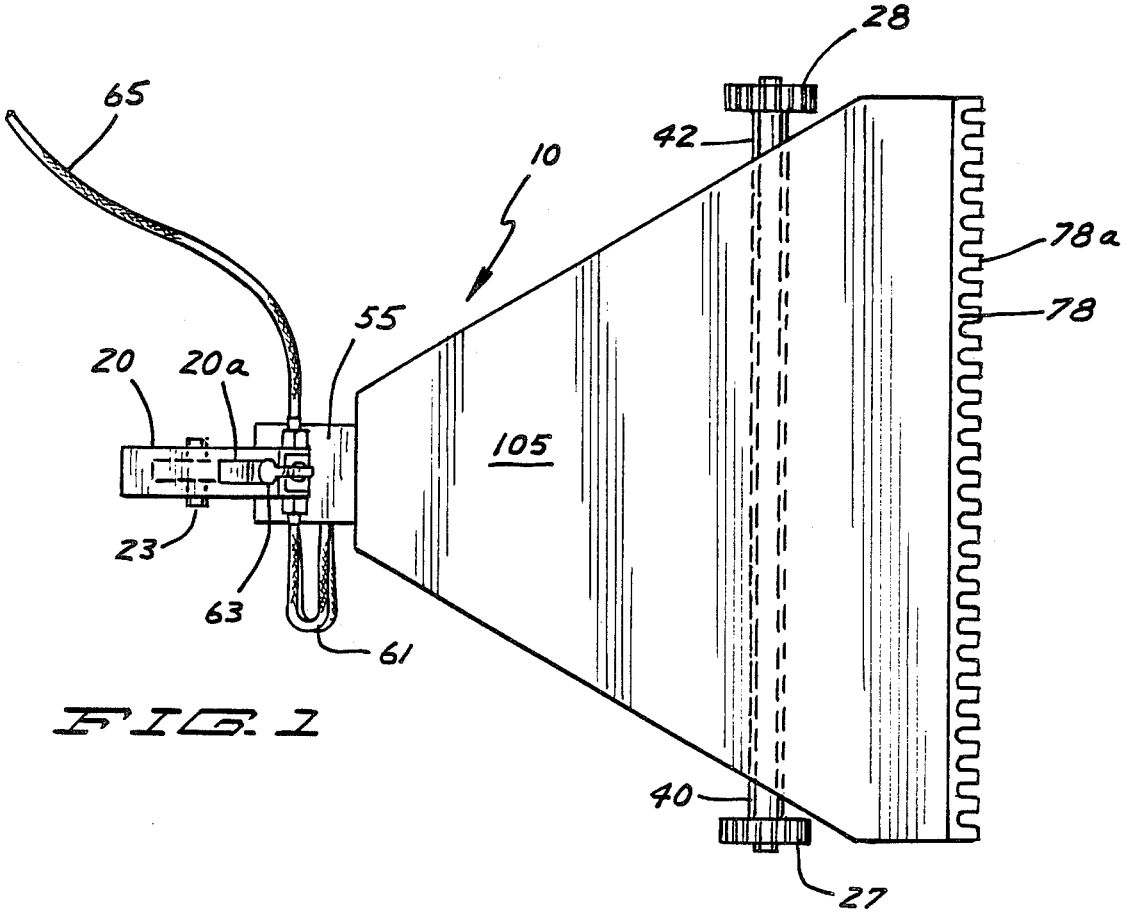
FIG. 1 is a view in top plan of the machine herein.
Figure 2:
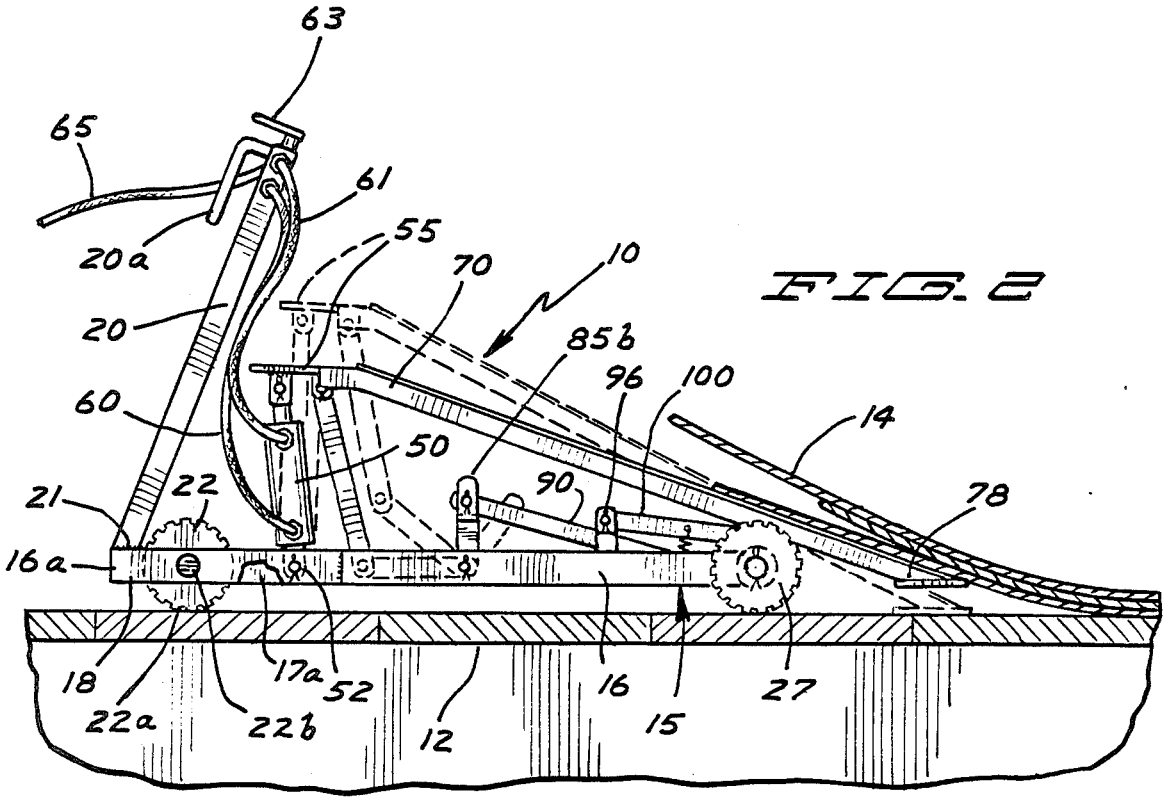
FIG. 2 is a view in side elevation of the machine herein in operating position with an alternate position of parts shown in dotted line.

Referring to the drawings, the shingle removing machine comprising the invention herein is indicated by the reference numeral 10. In FIG. 2, said machine is shown in an operating position on a roof 12 removing shingles 14.

The machine comprises a pair of horizontal forwardly diverging frame members 16 and 17 having adjoining rear end portions **16*a* and 17*a*. At the rear 21 of said end portions and welded thereto is an upstanding operating handle 20, said handle being angled forwardly into a convenient operating position. Said handle has a hand grip 20*a* adjacent the top thereof. Forwardly of said handle, said frame members accommodate therebetween a supporting wheel 22 which is journaled on a shaft 22*b*. Said wheel is shown having a tooth faced periphery 22*a*** for traction.

Extending directly forwardly of the juncture of said frame members 16 and 17 are a pair of spaced parallel frame members 18 and 19, the same being welded to said members 16 and 17 at their point of juncture which is not here shown.

Said members 16–19 respectively extend forwardly having secured to their respective ends sleeve members 22–25.

Extending through said sleeve members is a shaft 26 having journaled onto its ends wheel members 27 and 28 and spaced along said shaft are like wheel members 29–34, said wheels all having tooth like peripheries as at **22*a*. Said wheels are secured to said shaft by pins 36**.

Carried at the ends of said shaft inwardly of the end wheels 27 and 28 are sleeve members 40 and 42 said sleeves respectively extending to the sleeves 22 and 25. Mounted onto said shaft between the respective wheels 29–31 and 32–34 are sleeves 45–47.

The sleeves 23 and 24 are spaced apart and are respectively at the inner sides of the wheels 31 and 32. Further reference will be made to said spacers.

Mounted between said frame members 18 and 19 adjacent their juncture with the frame members 16 and 17 and upstanding therefrom is a master pneumatic cylinder 50 having a depending tongue 51 pivoted between said frame members 18 and 19 on a shaft 52 shown secured in position by a cotter key 53.

Adapted to rise upwardly from said cylinder 50 is a piston 54.

A plate member 55 having a bifurcated tongue 57 fits upon and is pivoted onto said piston 54 by a pin member 58 secured by a cotter key 59.

Said pneumatic cylinder has inlet and outlet lines 60 and 61 which pass to a control switch 63 in the upper portion of said handle 20 and from which a supply line 65 will run to a supply source such as an air compressor not here shown. It is to be understood that a pneumatic power source is indicated here for illustrative purposes and that alternative power means may be utilized within the scope of this invention.

Extending forwardly from said plate member 55 are as here shown six operating angle members 70–75 having their rear end portions appropriately secured as by welding to the sides of said plate member 55. The outermost of said members 70 and 75 form a diverging pair, spaced inwardly of said members 70 and 75 in the diverging pair 71 and 74 and the inner most pair 72 and 73 diverge to a corresponding lesser degree.

Figure 3:
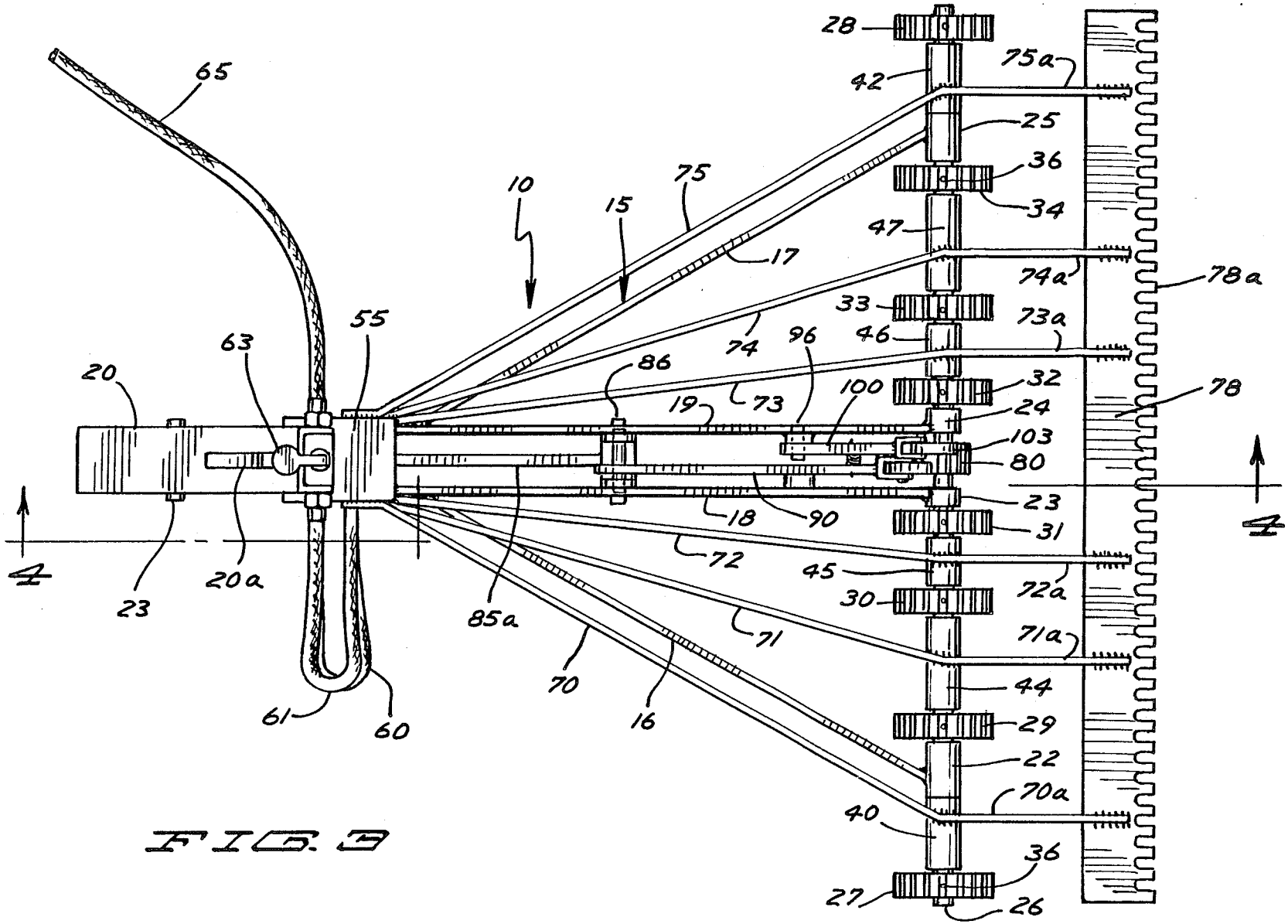
FIG. 3 is a view similar to FIG. 1 in top plan with the top cover plate member removed.
Figure 5:
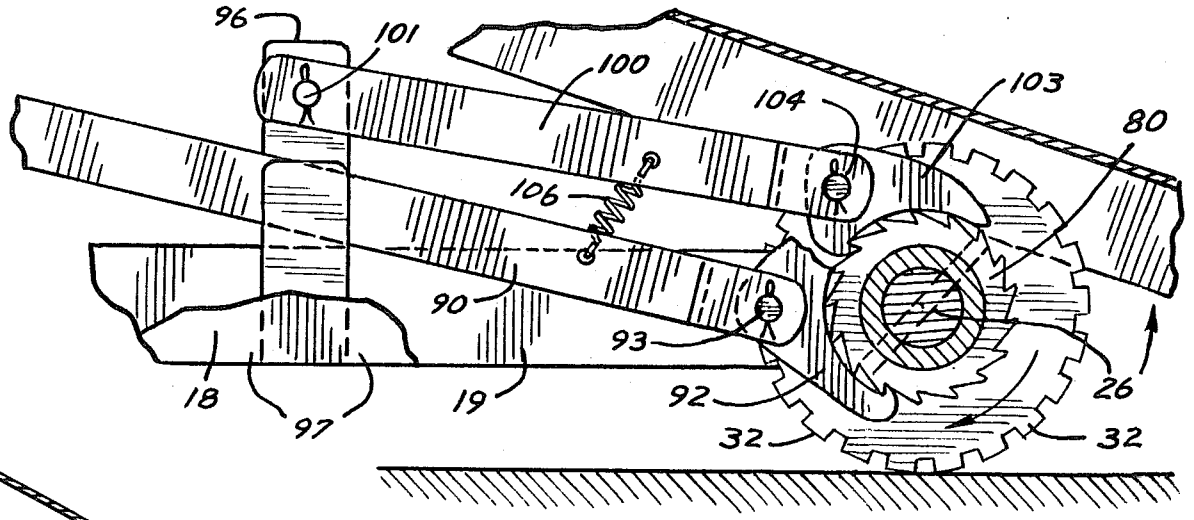
FIG. 5 is a broken view in vertical section showing a detail of structure on an enlarged scale.

Said members 70–75 respectively engage and are welded to the sleeve 40, 44–47 and 42 as viewed in FIG. 3 from the left to the right thereof.

Said members 70–75 have forwardly extended portions **70*a*–75*a* which extend at right angles to the axis of the shaft 26. Extending across the free ends of said extended portions is a blade member 78 having a deeply notched leading edge 78*a***.

Mounted centrally of said shaft 29 is a ratchet gear 80 secured to said shaft by a pin 81.

It is noted that the sleeves 23 and 24 are adjacent each side of said ratchet gear 80.

Figure 4:
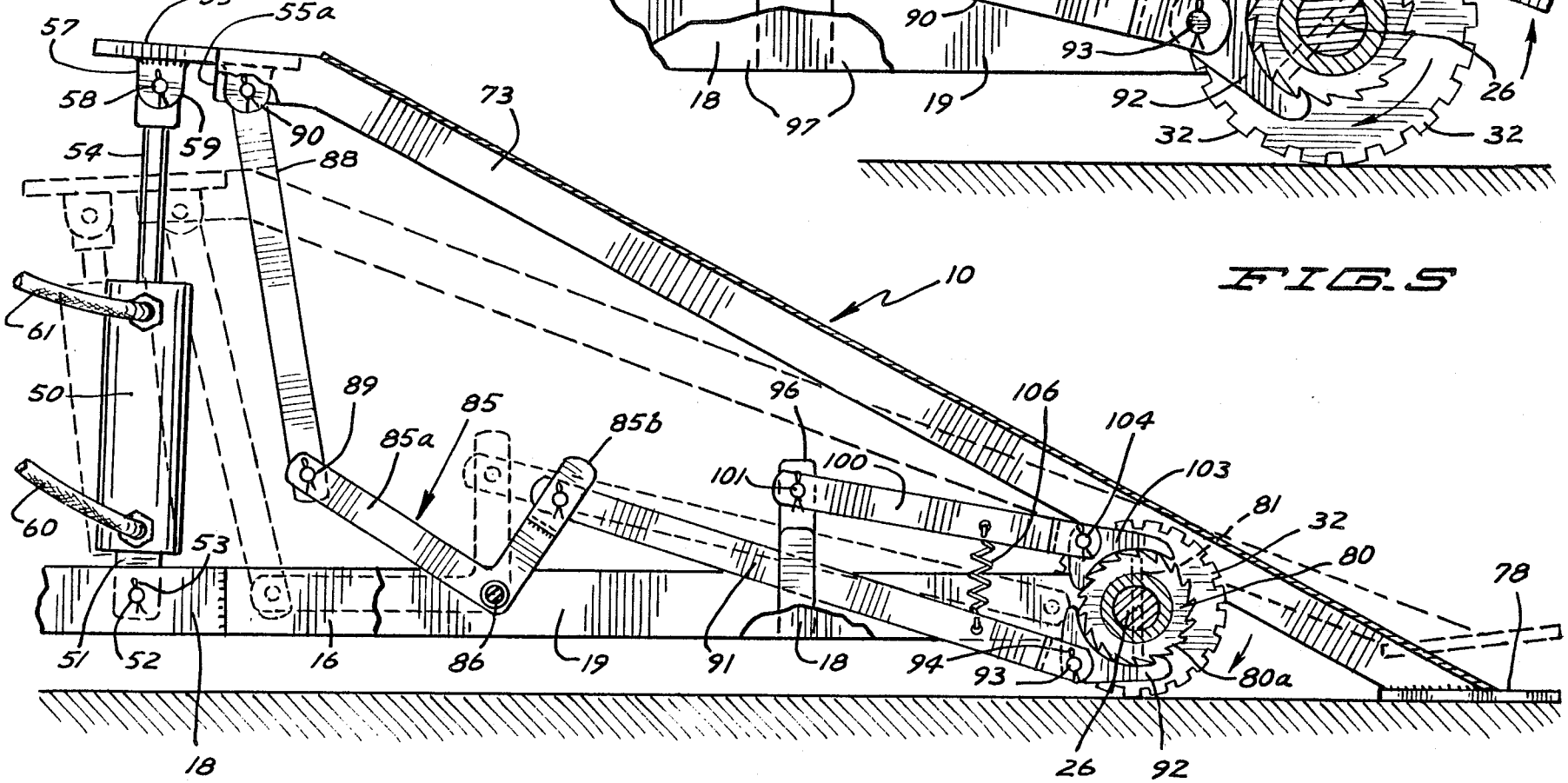
FIG. 4 is a view in vertical section taken on line 4—4 of FIG. 3 as indicated.

Referring to FIG. 4, a bell crank 85 is mounted on a shaft 86 between the frame members 18 and 19 forwardly of said pneumatic cylinder 50, said bell crank having lever arms 85*a* and 85*b*. Lever arm 85*a* has a link 88 pivoted thereto at 89 and extending upwardly to be pivoted at 90 to a depending flange 55*a* of said plate member 55.

Extending forwardly of said arm 85*b* is a link 90 having pivoted to its free end a ratchet member 92 secured by a pivot 93 held by a cotter key 94.

As shown the ratchet engages the lower portion of the gear 80 and more specifically the teeth 80*a* thereof.

Intermediate said bell crank 85 and said gear 80 is an upstanding post 96 welded to a stud 97 carried by the frame member 19.

Extending forwardly of the post 96 is a link 100 pivoted to said post at 101 and having extending from its forward end a ratchet pawl 103 secured by a pivot 104.

A coil spring 106 is shown connecting the links 90 and 100 adjacent the ratchet and ratchet pawl to keep and hold the same in operating engagement with said gear 80.

Overlying the members 70–75 down to the blade 78 is a hood 105 which will be suitably secured to the plate member 55 in a suitable manner not here shown.

The operation of the machine herein will now be described.

The machine is sufficiently light in weight that it may be manually lifted onto a roof for removal of shingles. The machine is positioned to have the blade 78 face the leading edge of a row of shingles.

The line 65 is connected to a pneumatic power source and the valve control member 63 is thumb operated to actuate the piston 54 of the cylinder 50 and the piston reciprocates the plate member 55.

On the upstroke of said piston, the bell crank 85 and its linkage move the ratchet 92 forwardly of the bottom portion of the gear 80, the ratchet 92 sliding over the teeth thereof which are disposed to be counter clockwise.

On the downstroke of said piston 54, the bell crank and its links are retracted drawing the ratchet 92 clockwise of said gear 80 and thus drive said shaft 26 to move the machine forwardly.

It will be seen that with the upward and downward strokes of the piston 54 that the members 70–75 with their respective sleeves are caused to rock on the shaft 26. The upward stroke of the piston lowers the blade 78 and the downward stroke of said piston moves the machine forward along with the leading edge of the blade 78 causing the blade to be urged to move into a position of underlying an adjacent leading edge portion of shingles. The succeeding downstroke rocks said members 70–75 to have their forward end portions and the blade carried thereon lifted. This elevating movement caused the blade 78 to lift the overlying shingles and tear them loose of the roof boards. The blade 78 is of sufficient width to underlie and free up several tabs of shingles at each such effort.

Thus the action of the piston rocks or pivots said members 70–75 and their respective sleeves and coupled with the forward movement of the machine and the blade 78 there is defined an eliptical path of movement in under engaging the shingles, riasing them to tear them free of the roof boards and then lowering the blade 78 to be positioned to engage the next lower row of shingles.

The link 100 and its pawl 103 are stationary, the pawl prevents the gear 80 and consequently the machine itself from moving rearwardly.

The operator moves the machine to position the same to engage the shingles. Normally, the machine will either be moved laterally across a roof and then lowered one row of shingles or it is moved from top to bottom of a roof to remove substantially vertical rows of shingles.

The pneumatic cylinder actuated by the thumb operated switch 63 does the heavy duty work. The positioning of the machine is readily accomplished. The work effort otherwise involved is greatly reduced and a very important element is the reduction in time and cost involved. With the work load on the operator reduced and the time involved in any given shingle removing job, there is a substantial cost reduction in doing the work and the operator is thus provided with a significant advantage in bidding for jobs.

The machine is readily moved rearwardly by disengaging the ratchet member 103.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A shingle removing machine having in combination a frame having a rear wheel support and a plurality of spaced front wheels, a shaft having said front wheels mounted thereon, sleeves carried on said shaft between said wheels, a power actuated cylinder having a vertically movable piston, a plate member carried at the top of and operated by said piston, a plurality of operating members diverging forwardly from said plate member, each of said operating members extending over and being secured to a respective of said sleeves and having terminal portions extending beyond said sleeves, a blade member extending across and being secured to said terminal portions, a driving gear on said shaft, means connecting said plate member and said gear engaging and driving said gear, whereby a movement of said plate member causes said blade to move downwardly underlying adjacent facing shingles and a second movement of said plate member causes a forward movement and a lifting action of said blade which causes said shingles to come free of the underlying roof boards, and a handle upstanding at the rear of said frame.

2. The structure of claim 1, wherein said connecting means comprises, linkage connecting said plate member and said gear, a ratchet forming the terminal portion of said linkage engaging said gear, and a pawl, means supporting said pawl in engagement with said gear stopping backward movement of said gear.

3. The structure of claim 1, wherein said connecting means comprises linkage connecting said plate member and said gear,
said linkage including a bell crank,
means in connection with said frame supporting said bell crank,
whereby upward movement of said piston moves said bell crank to cause said linkage to move said gear forwardly.

4. The structure of claim 1, including
a pair of transversely spaced frame members extending from adjacent the rear of said frame forwardly to be secured to sleeves adjacent each side of said gear,
a bell crank pivoted to one of said frame members,
said connecting means comprising a linkage,
said bell crank being an intermediate link in said linkage,
a ratchet being a terminal portion of said linkage,
said ratchet engaging said gear and driving the same,
an upstanding post secured to the other of said frame members,
a link pivoted to said post, and
a pawl forming the terminal portion of said link and engaging said gear preventing backward movement of said gear.

* * * * *